US008051580B2

(12) United States Patent
Bruneau et al.

(10) Patent No.: US 8,051,580 B2
(45) Date of Patent: Nov. 8, 2011

(54) CLOTHES DRYER MOTOR SUPPORT ASSEMBLY

(75) Inventors: Pierre-André Bruneau, Montreal (CA); Jamie Roy, Montreal (CA); Dominique Larochelle, St-Bruno (CA)

(73) Assignee: Mabe Canada Inc., Burlington (CA)

( * ) Notice: Subject to any disclaimer, the term of this patent is extended or adjusted under 35 U.S.C. 154(b) by 647 days.

(21) Appl. No.: 12/285,338

(22) Filed: Oct. 2, 2008

(65) Prior Publication Data

US 2009/0242727 A1 Oct. 1, 2009

(30) Foreign Application Priority Data

Mar. 28, 2008 (CA) ..... 2627713

(51) Int. Cl.
*F26B 11/02* (2006.01)
*H02K 5/24* (2006.01)
*H02K 5/00* (2006.01)
*F16M 9/00* (2006.01)

(52) U.S. Cl. ..... 34/603; 310/51; 310/91; 248/677; 248/678; 248/638

(58) Field of Classification Search ..... 310/51, 310/91; 267/140.11; 248/688, 581, 689, 248/693, 561, 560, 610, 612, 678, 680, 346.01, 248/677, 638, 674, 672, 633, 601; 62/508; 34/601, 603, 108; 312/223.1, 351.8, 351.1; 68/3 R See application file for complete search history.

(56) References Cited

U.S. PATENT DOCUMENTS

| | | | | |
|---|---|---|---|---|
| 3,513,566 | A | 5/1970 | Shacklock et al. | |
| 3,630,490 | A * | 12/1971 | Horgan, Jr. | 256/24 |
| 4,061,002 | A | 12/1977 | Drews | |
| 4,123,851 | A | 11/1978 | Itoh et al. | |
| 5,257,448 | A * | 11/1993 | Pearce et al. | 29/434 |
| 5,651,381 | A * | 7/1997 | Balouchian | 134/138 |
| 6,378,834 | B1 | 4/2002 | Baker | |
| 6,874,248 | B2 | 4/2005 | Hong et al. | |
| 7,093,378 | B2 | 8/2006 | Jeong et al. | |
| 7,828,262 | B2 * | 11/2010 | Saito | 248/638 |
| 2005/0132601 | A1 | 6/2005 | Doh | |

* cited by examiner

*Primary Examiner* — Kenneth Rinehart
*Assistant Examiner* — John McCormack

(57) ABSTRACT

The present invention relates to a dryer motor assembly support that limits or eliminates cabinet vibration and noise. The dryer comprises a cabinet comprising a floor having an outside peripheral portion, and a central portion with four openings. The dryer further comprises a motor assembly, having a motor and motor mount comprising a base, spaced above the openings. A support assembly for supporting the motor assembly comprises two parallel spaced apart support portions each spaced below and spanning across the central portion, passing beneath the openings. Each support portion has oppositely disposed end portions secured with the peripheral portion. Each support portion comprises two projections extending therefrom toward the base. Each projection passes through a corresponding one of the openings with clearance to secure the support portion with the base, isolating the motor. The motor and support assembly, and the openings are co-located away from the central portion.

28 Claims, 12 Drawing Sheets

CLOTHES DRYER MOTOR SUPPORT ASSEMBLY

FIELD OF THE INVENTION

The present invention relates to a clothes dryer motor support assembly, more particularly, it relates to the support of the motor relative to the dryer cabinet.

BACKGROUND OF THE INVENTION

Clothes dryer motor assemblies typically comprise a motor mount having a motor mounted thereto. The motor mount may rest directly on a floor of the dryer cabinet or may rest atop a raised floor portion. In other prior assemblies, the motor is suspended from above by a raised platform.

Clothes dryer motors produce a substantial amount of vibration which may be transmitted to the cabinet floor. This vibration produces noise as the cabinet vibrates. In some cases, the motor vibration may cause the dryer cabinet, or more specifically, the cabinet floor, to resonate. Resonance can generate loud unwanted noise. Vibration and noise are very displeasing to a user of the clothes dryer.

In the past, clothes dryer apparatus have been developed to overcome the problem of motor vibration, resonance, and noise. Some assemblies include a raised floor portion in order to strengthen the structure upon which the motor assembly rests. However, the raised floor portion takes up space inside the dryer cabinet.

Other designs include means of insulating the motor from the cabinet via the placement of rubber insulators between the motor mount and the cabinet. The rubber insulators cushion the motor, thus reducing transmittance of motor vibration. However, these methods may not overcome the problem of resonance. Further, the addition of rubber insulators to the motor assembly takes up space inside the dryer cabinet and requires the use of additional materials to be used for insulation.

Yet another type of apparatus used to reduce vibration and noise created by the motor includes the application of an insulating ring for insulating the motor shaft bearing from the motor mount. Apparatus such as these may not solve the problem of resonance and once again include additional insulating materials, which can increase cost and assembly time. Further, the placement of an insulating ring between the motor shaft bearing and the motor mount requires complicated assembly and thus increases costs associated with time and labour.

As a result of these deficiencies in past practices, it is clear that there is a need for an apparatus that effectively supports the motor assembly without taking up additional space in the cabinet, while reducing noises and vibration.

BRIEF DESCRIPTION OF THE INVENTION

The present invention relates to a clothes dryer motor support assembly, more particularly, it relates to the support of the motor relative to the dryer cabinet.

In accordance with one embodiment of the present invention, there is provided a clothes dryer comprising a cabinet comprising a floor. The floor comprises a central portion, an outside peripheral portion, and at least one opening passing through the central portion. There is further provided a motor assembly located inside the cabinet and spaced above floor over the at least one opening. The motor assembly comprises a motor and a motor mount for mounting of the motor thereto. The motor mount further comprises a base. The clothes dryer further provides a support assembly comprising at least one support portion spaced below and spanning across the central portion of the floor of the cabinet. The support portion passes beneath the at least one opening. The support portion comprises oppositely disposed end portions secured with the outside peripheral portion of the floor. One of the support portion and the motor mount base further comprises at least one projection extending therefrom toward the other one of the support portion and the motor mount base. The at least one projection passes through the at least one opening with clearance to secure the support portion with the base of the motor mount whereby the motor is supported within the cabinet and is isolated from the central portion of the floor.

By isolating the motor from the central portion of the floor, vibration of the floor due to motor operation is reduced. Further, by placing the support portion below the central portion of the cabinet floor, the support portion is not located in the cabinet taking up space in the cabinet.

It should be understood that several combinations of the number of projections to the number of openings in the central portion of the floor may fall within the realm of the present invention. For example, all projections may pass through a single opening in one combination and in another combination, there is one opening corresponding to each projection. In yet another exemplary combination, two projections may pass through a first corresponding opening while another three projections may pass through a second corresponding opening. As can be appreciated, there can be several combinations depending on the number of projections and openings utilised.

The motor assembly, the support assembly and the at least one opening may be co-located away from a center of the central portion of the floor.

In accordance with another embodiment of the present invention, there is provided at least two openings passing through the central portion. The clothes dryer further comprises a support assembly comprising two parallel spaced apart support portions each spaced below and spanning across the central portion of the floor of the cabinet. The support portions pass beneath the openings. Each support portion comprises oppositely disposed end portions secured with the outside peripheral portion of the floor. Each support portion comprises at least one projection extending from the support portion toward the motor mount base. Each projection passes through a corresponding one of the openings with clearance to secure the support portion with the base of the motor mount whereby the motor is supported within the cabinet and is isolated from the central portion of the floor.

In accordance with yet another embodiment of the present invention there is provided four openings passing through the central portion of the floor. Further, the clothes dryer comprises a support assembly comprising two parallel spaced apart support portions each spaced below and spanning across the central portion of the floor of the cabinet. Each support portion further comprises two projections extending from the support portion toward the motor mount base with each projection passing through a corresponding one of the openings with clearance to secure the support portion with the base of the motor mount whereby the motor is supported within the cabinet and is isolated from the central portion of the floor. The motor assembly, the support assembly, and the four openings are co-located away from a central portion of the floor.

The cabinet may further comprise front, rear, and side walls mounted to the outside peripheral portion of the floor.

In an alternative embodiment, the support portion comprises at least one material more rigid than the floor of the cabinet for reducing vibration transmitted from the motor to the cabinet floor via the support portion.

A center of the central portion of the floor may comprise a first resonant frequency corresponding to a motor vibration frequency. The at least one material comprising the support portion may comprise a second resonant frequency that is different from the first resonant frequency and harmonics thereof.

In one embodiment, the support end portions each further comprise at least one bendable locating tab. Each locating tab passes through a corresponding aperture in the outer peripheral portion of the cabinet floor. The aperture is configured to permit the passage of the locating tab therethrough. The bendable locating tab is bent to locate the support assembly relative to the floor. Each support end portion further comprises at least one end portion hole. The outer peripheral portion comprises at least one peripheral portion hole. The peripheral portion hole is aligned with the end portion hole. Each end portion is fastened to the outer peripheral portion by a threaded screw passing through the end portion hole and the peripheral portion hole.

In another embodiment, the cabinet side walls each comprise an inwardly depending flange portion for the attachment of the side wall to the cabinet floor. The inwardly depending flange portion and the outer peripheral portion of the floor sandwich the support portion end portions. The inwardly depending flange portion further comprises flange holes aligned with and corresponding in diameter to the end portion holes and the peripheral portion holes for the passage of the threaded bolt or screw therethrough. The unthreaded bolt or screw passes through the flange hole, the end portion hole and the peripheral portion hole to secure the end portion.

BRIEF DESCRIPTION OF THE DRAWINGS

For a more thorough understanding of the nature and objects of the present invention reference may be had, by way of example, to the accompanying diagrammatic drawings in which.

DETAILED DESCRIPTION OF THE INVENTION

Figure 1:
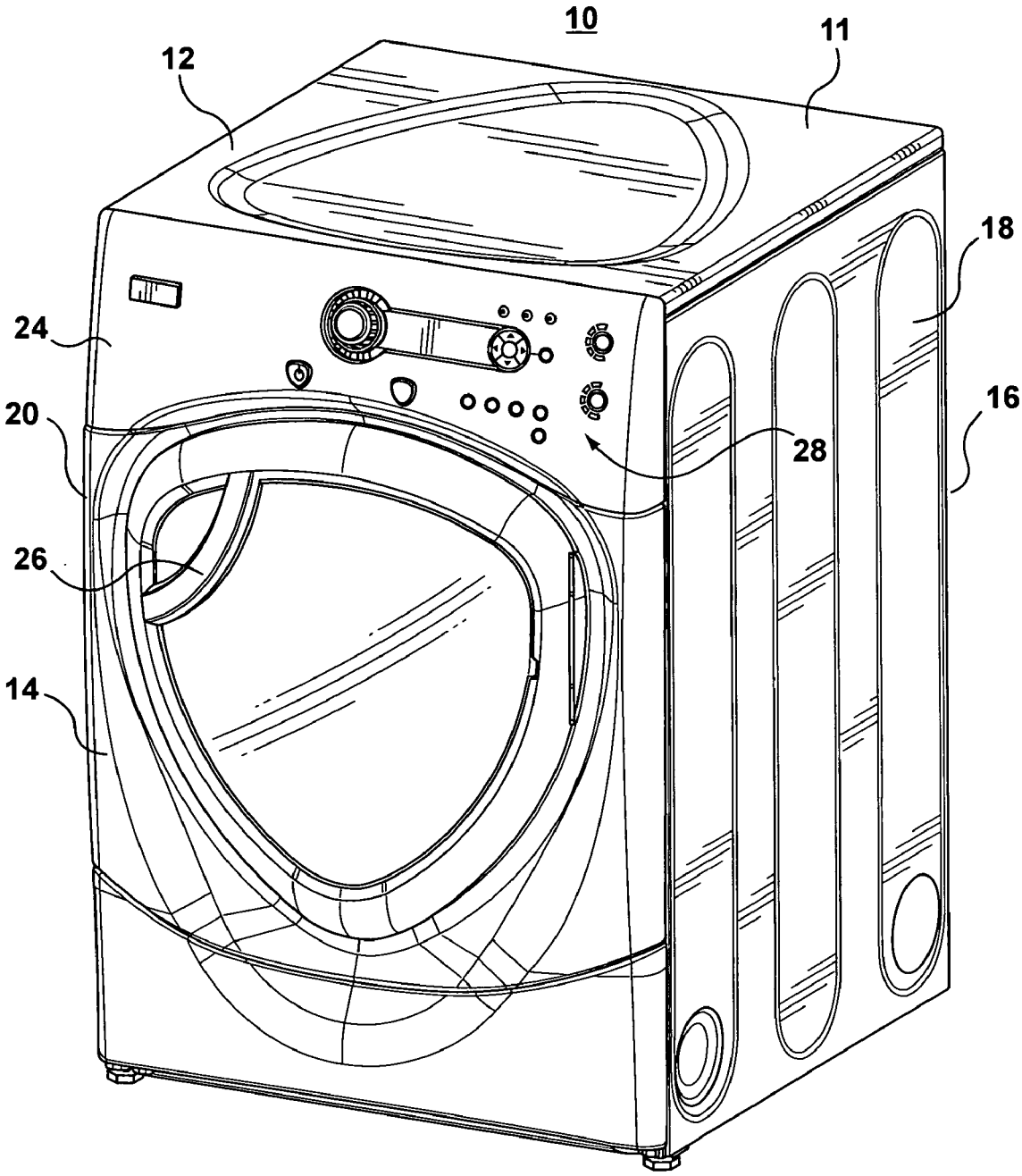
FIG. 1 represents an exemplary clothes dryer which may benefit from the present invention.

Referring to FIG. 1, there is shown a clothes dryer 10 comprising a cabinet 11. The cabinet has a top panel 12, a front wall 14, rear wall 16 and side walls 18, 20 and a floor panel (not shown). The clothes dryer 10 includes a control panel 24 where a user can input commands related to the functioning of the dryer 10 via controls 28. Although FIG. 1 shows an electronic control panel, other embodiments may include an analog control panel. The clothes dryer 10 further includes a door 26 which, when opened permits access to the rotating dryer drum (not shown) for the insertion and removal of clothing articles (not shown) therefrom. The clothes dryer 10 further includes four adjustable feet 17 located at the lower corners of the clothes dryer 10. These feet 17 together with rear dryer floor supports (not shown) support the clothes dryer 10 above a floor or ground of a room in which the dryer is operated.

Figure 2:
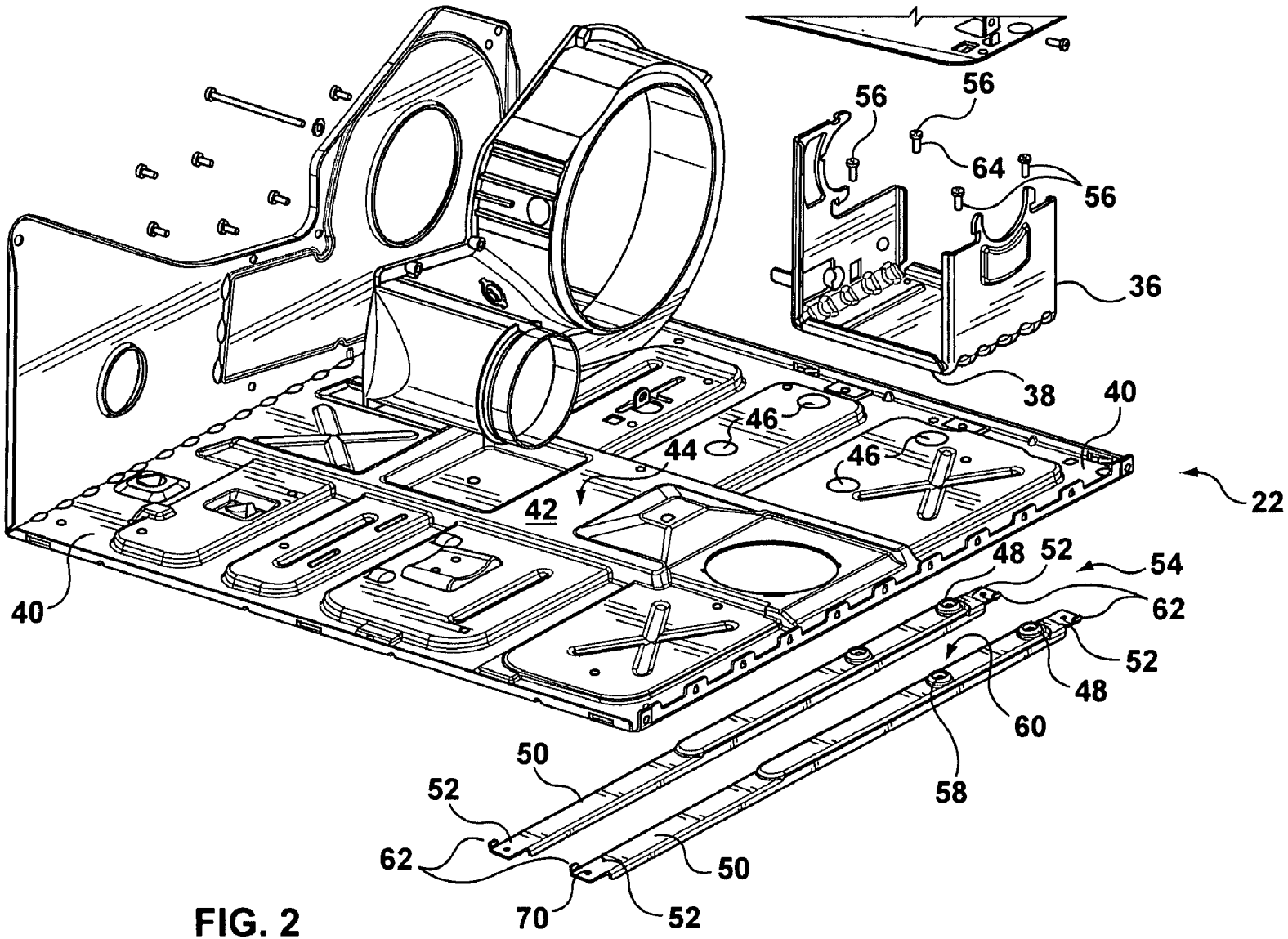
FIG. 2 is an exploded perspective of the clothes dryer showing the floor and one embodiment of the support assembly.
Figure 3:
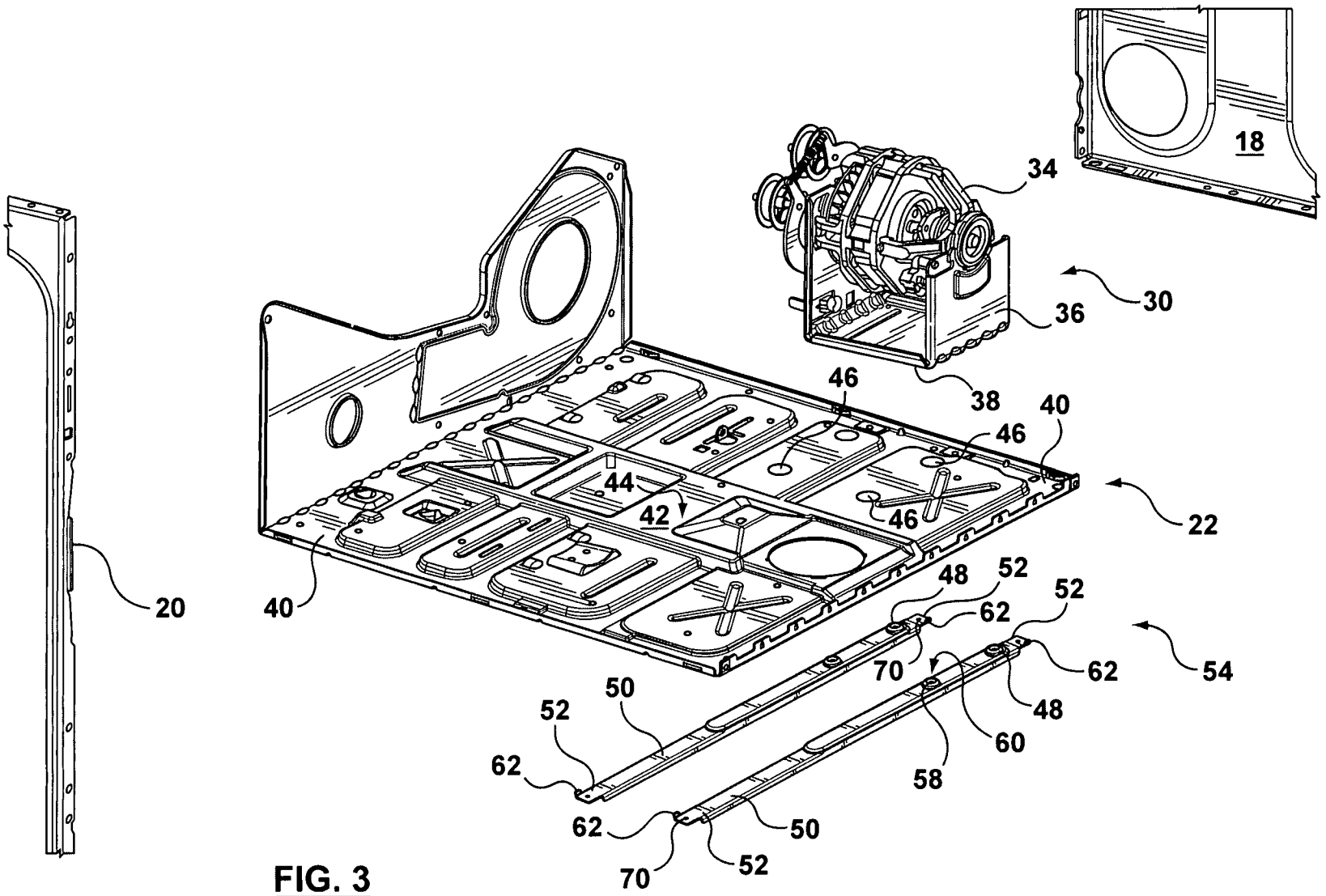
FIG. 3 is an exploded perspective of the clothes dryer showing the floor, the motor assembly and the support assembly.

In FIGS. 2 and 3 the floor 22 of the cabinet 11 is shown in detail. The floor 22 of the cabinet 11 comprises an outer peripheral portion 40 and a central portion 42. The central portion of the floor 42 further comprises a center 44. The central portion 42 has holes 46 located off center from the center 44. The purpose of these holes is discussed hereinafter.

In FIG. 3, a motor assembly 30 includes a motor 34 and a motor mount 36 for the mounting of the motor 34 thereto. The motor 34 is used to drive the rotating dryer drum via a transmission (not shown). In other embodiments, the motor 34 may also be used to power a centrifugal fan (not shown). The motor mount 36 comprises a motor mount base 38. As shown in FIG. 2, the base 38 may be ribbed in order to add rigidity to the structure of the motor mount 36. When assembled, the base 38 is spaced above the central portion 42 of the floor 22, over openings 46.

Referring to FIGS. 2, 3, 4, 8 and 9, the support assembly 54 is shown for supporting the base 38 spaced above the central portion 42 of the floor 22, over openings 46. In the preferred embodiment there are four openings 46. In the preferred embodiment, the support assembly 54 comprises two spaced apart and parallel extending support portions 50. The support portions 50 further comprise oppositely disposed end portions 52. The support portions 50 span across the central portion of the floor 42 and are spaced below the central portion 42 of the cabinet floor 22 such that the support portions 50 do not touch the central portion 42 of the cabinet floor. The support portions 50 have end portions 52 that are secured to the outer peripheral portion 40 of the cabinet floor 22. In the embodiment shown, projections 48 extend from and are integrally formed with the support portions 50 and corresponds in number to the number of openings 46. The projections 48 may comprise a dome-shaped prominence (not shown) having a central recess (not shown). The projections 48 pass through the openings 46 and contact the base of the motor mount 38. In the embodiments shown, the projections 48 with the assistance of screws 56 secure the motor mount 38 with the support portions 50. Further, the projections 48 are sufficiently sized as to cause the motor mount base 38 to be spaced above the floor of the cabinet 22 over the openings 46, and the support portions 50 to be spaced below the floor of the cabinet 22. Moreover, the openings 46 are sufficiently sized as to permit the passage of the projections 48 therethrough with clearance. Thus, the motor 34 is isolated from the central portion 42 of the floor 22. It should further be understood that the support portions 50 are spaced above the floor of the room in which the dryer 10 is located by the feet 17 together with rear dryer floor supports (not shown).

Figure 8:
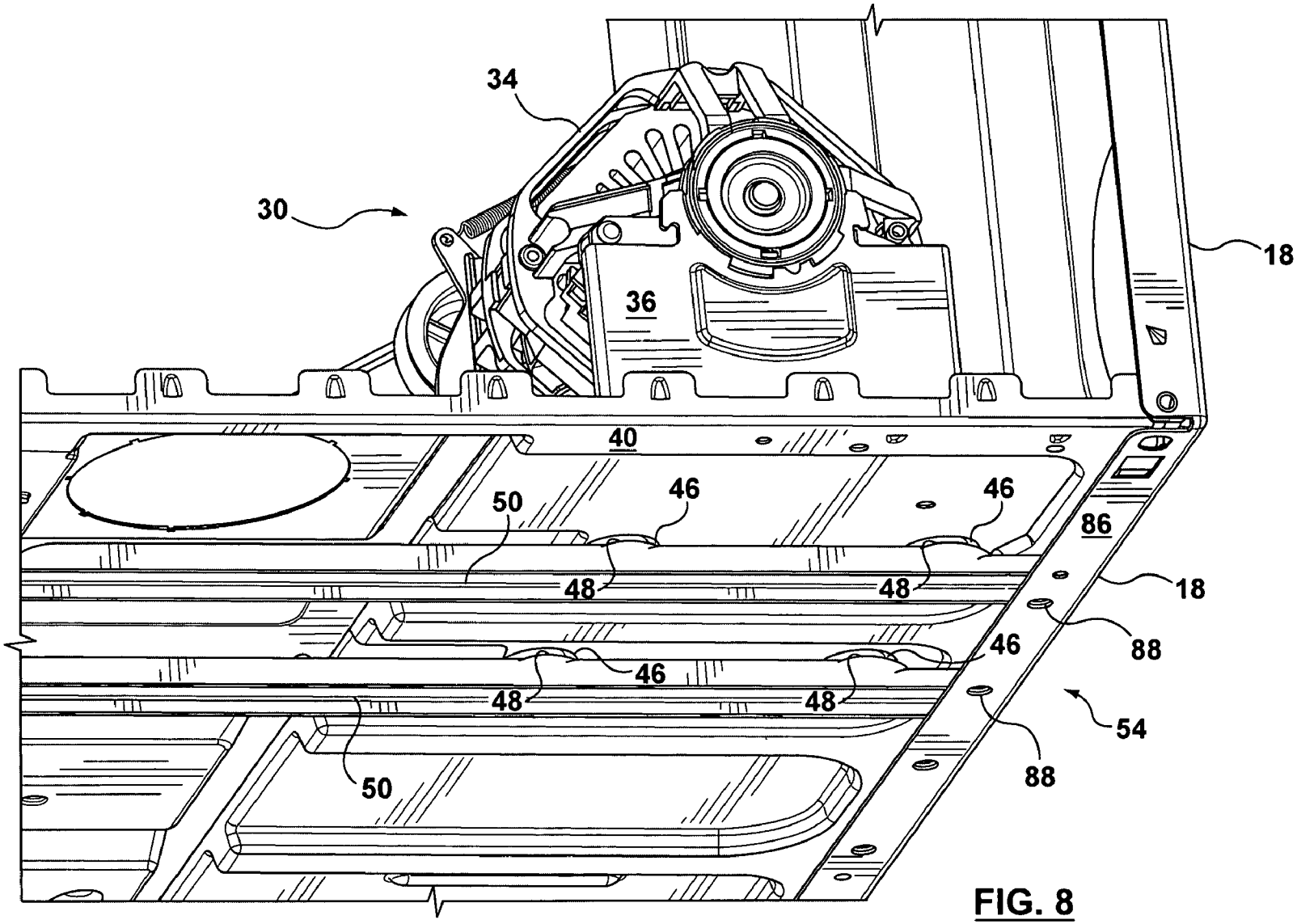
FIG. 8 is a perspective view beneath the cabinet floor showing the mounting of the support assembly to the floor.

Referring to FIGS. 2, 3 and 8, the motor assembly 30, the support assembly 54 and the openings 46 are preferably co-located away from the center 44 of the floor 22. FIGS. 2 and 3 show the center 44 of the floor 22. The center 44 is an area that is highly responsive to vibration and resonance imparted to it. Since the floor 22 is more rigid away from the center 44, the effects of any residual vibration will be highly reduced away from the center 44. It should be understood that the motor assembly 30, the support assembly 54, and the openings 46 may be co-located nearer to or at the center 44, but that the effects of vibration are greater the closer their location to the center 44.

It should be understood that in alternative embodiments, the projections 48 could be separate pieces from the support portions 50 and fastened thereto by suitable means. Also in the alternative embodiment shown in FIG. 5*d*, it should be understood that the projections 48 may extend from the motor mount base 38 towards the support portion 50.

Figure 6:
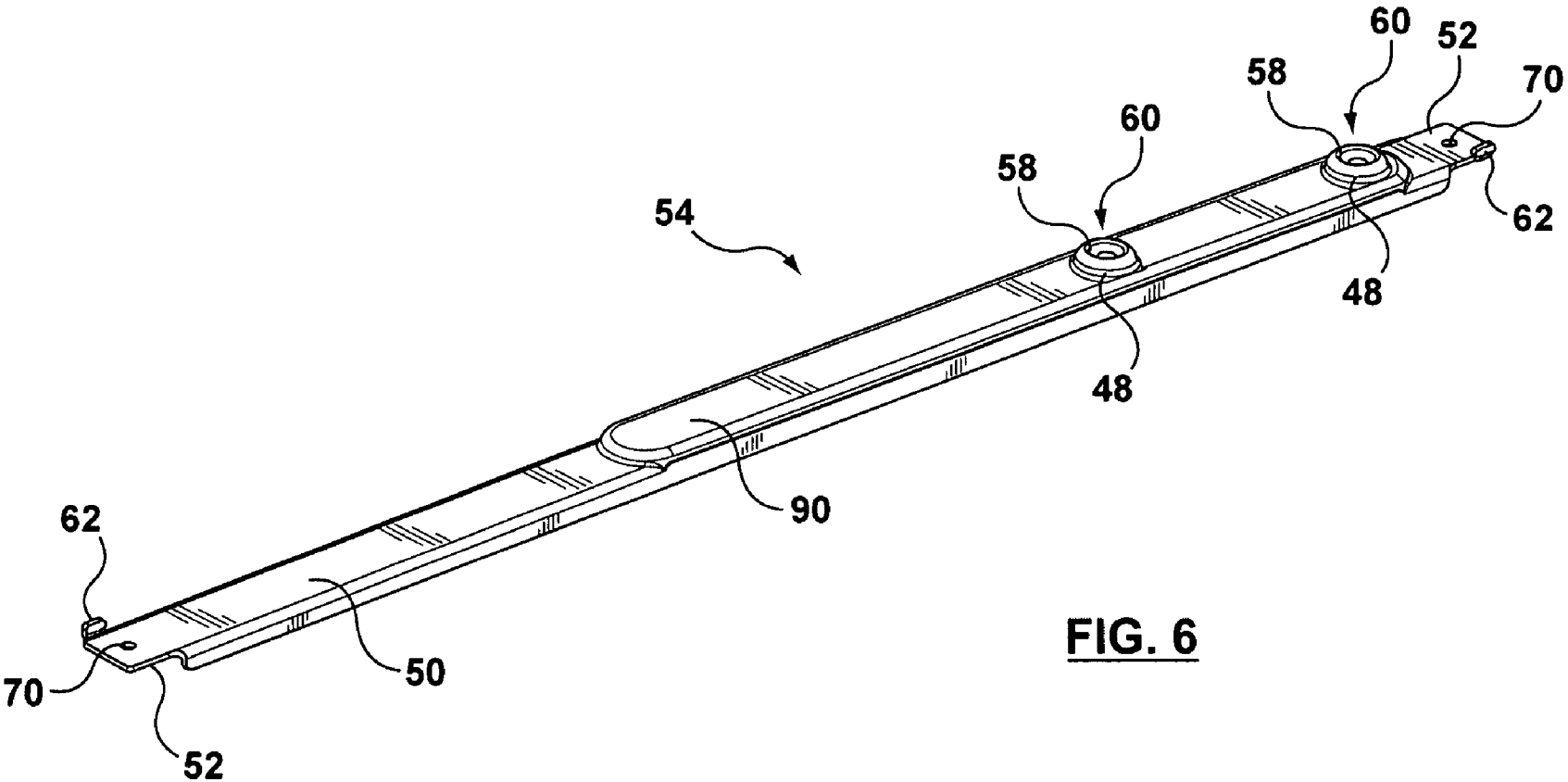
FIG. 6 is a perspective view of one embodiment of a support portion.
Figure 6A:
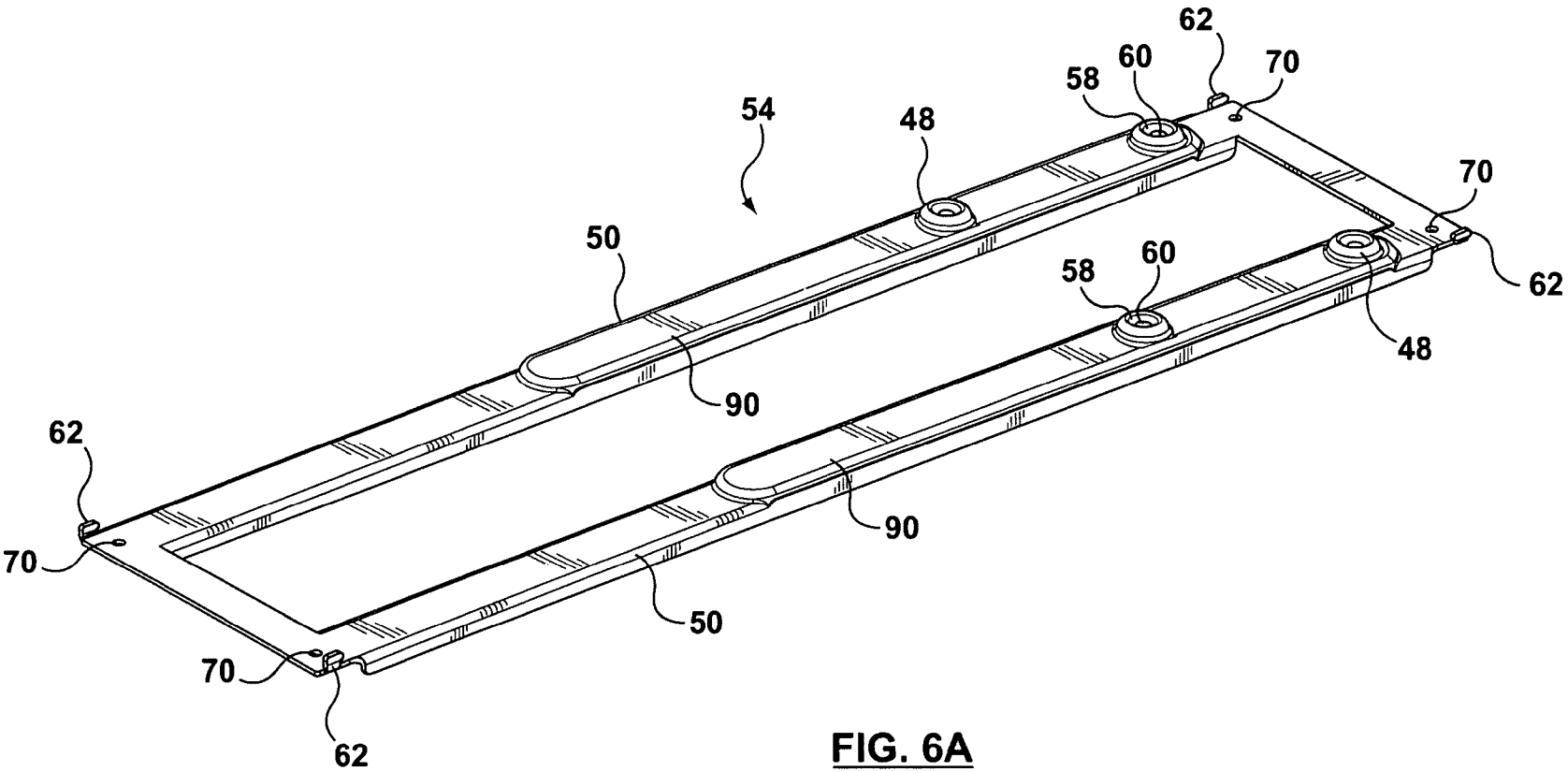
FIG. 6*a* is a perspective view of another embodiment of a support portion.
Figure 6B:
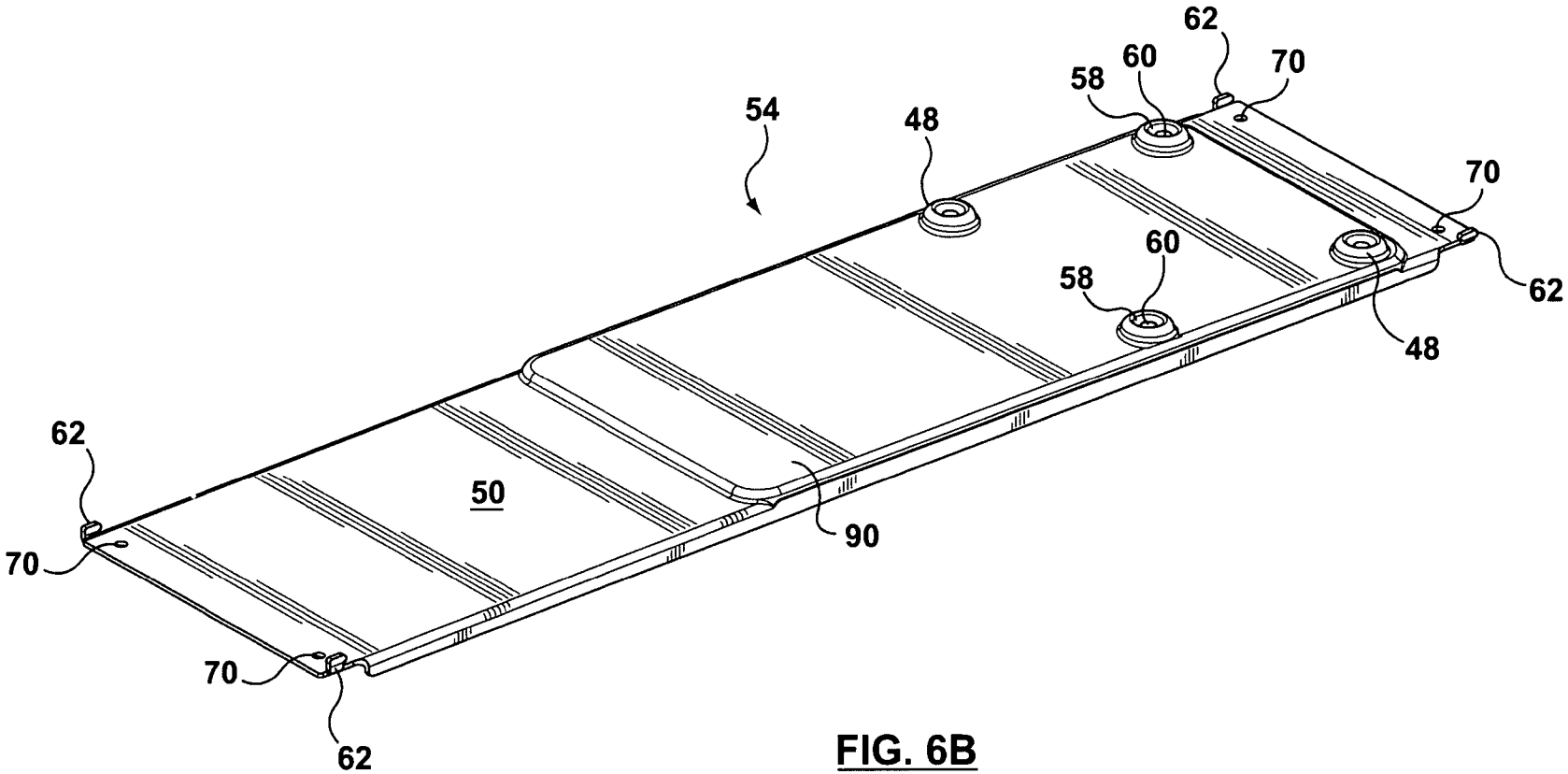
FIG. 6*b* is a perspective view of yet another embodiment of a support portion.

Further, in some embodiments, the support portion 50 may further comprise a raised platform portion 90 (FIGS. 6, 6*a*, 6*b*). The raised platform portion 90 elevates the projections 48 should the openings 46 be located at a raised portion of the central portion 42 of the floor 22.

The center 44 of the central portion of the floor 42 has a resonant frequency associated therewith. This resonant frequency has been known to correspond to a harmonic of the frequency at which the motor 34 vibrates when in operation. It is preferred that the material or materials from which the support portion(s) 50 is comprised has a second resonant frequency different from the operating frequency of the motor or harmonic frequencies of this operating frequency. Further, the support portion 50 is more rigid than the cabinet floor 22 which limits or eliminates the transmittance of vibration from the motor 34 to the cabinet 11 via the support portion 50.

In the preferred embodiment, the central portion 42 may resonate at a frequency of approximately 360 Hz. The motor 34 of the preferred embodiment operates at a frequency of approximately 60 Hz. Resonance of the cabinet floor 22, may cause increasing amounts of noise. In order to reduce noise, vibration due to the motor operating frequency is kept from transferring directly to the central portion 42 of the cabinet floor by having the support portion 50 comprised of at least one material having a resonant frequency different from 360 Hz and not related to a harmonic frequency of the motor operation. This embodiment improves rigidity to the structure supporting the motor 34 to prevent or limit the transmittance of vibration from the motor 34 to the cabinet 11 via the support portion 50. Further, the motor assembly 30 is supported such that neither the motor assembly 30 nor the support assembly 54 is in contact with the central portion 42 of the floor. The at least one support portion 50 of the support assembly 54 may comprise various embodiments.

Figure 4:
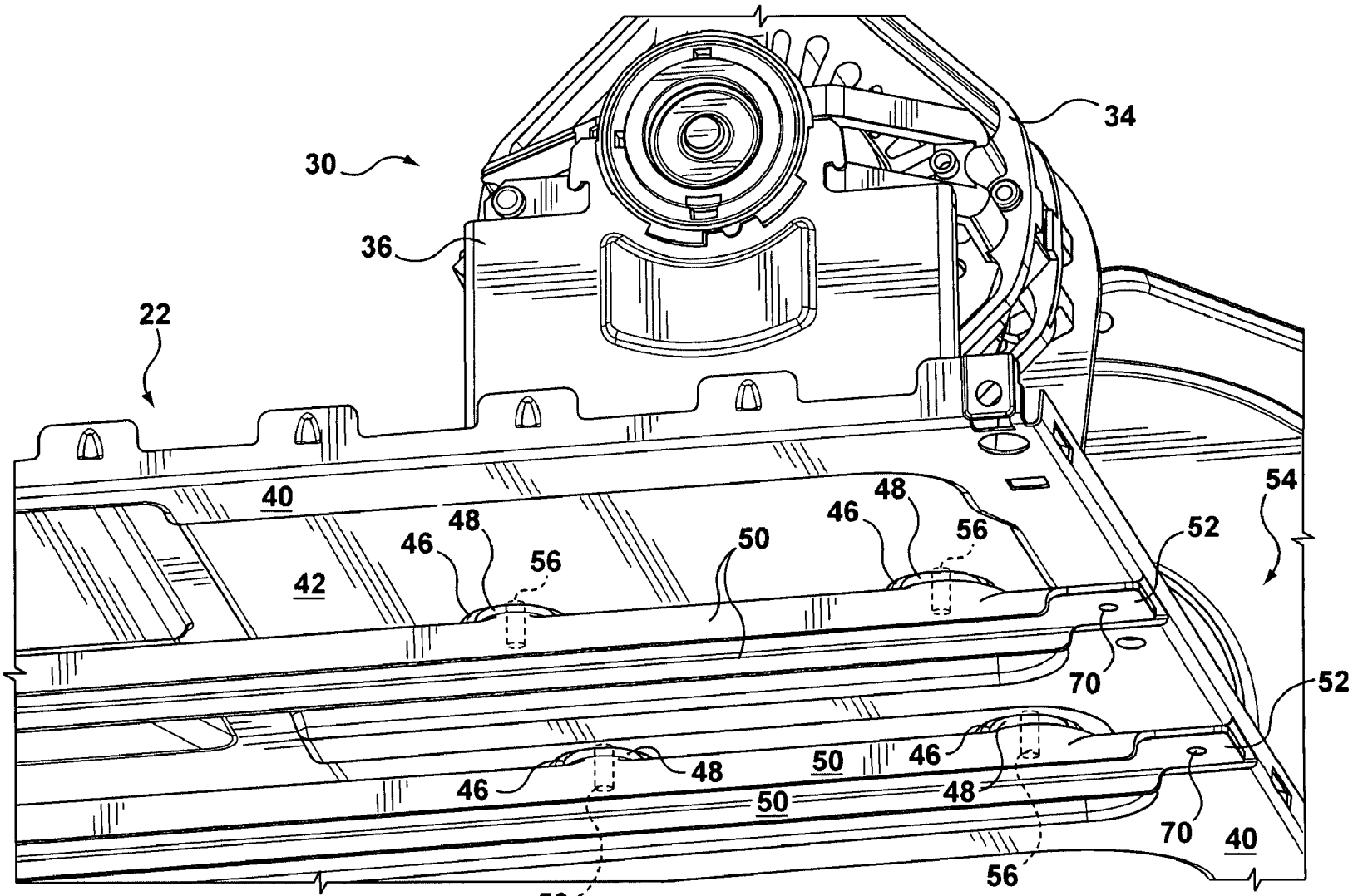
FIG. 4 is a perspective view beneath the cabinet floor showing the support assembly secured to the floor.
Figure 5:
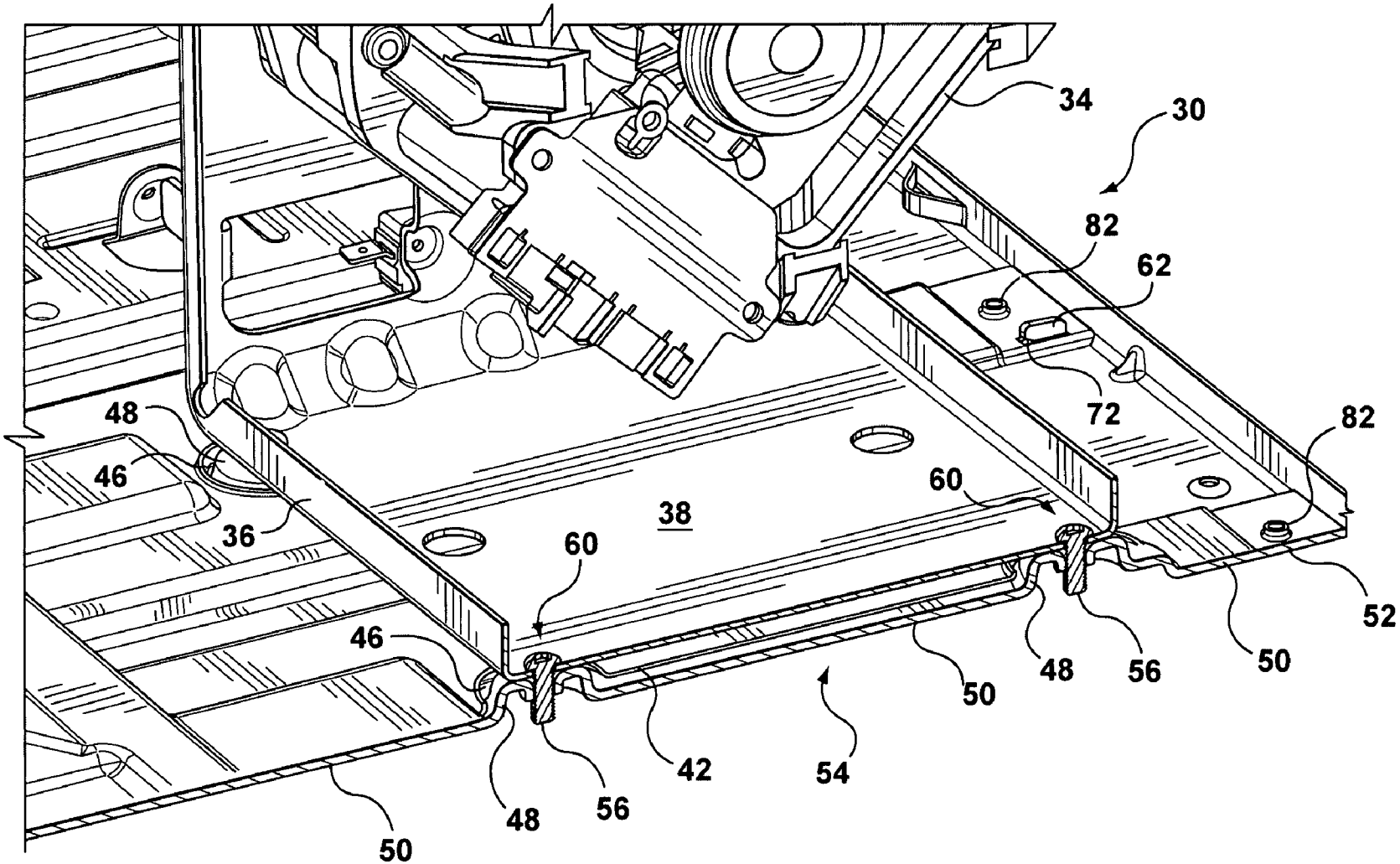
FIG. 5 is a perspective view of one embodiment showing the relationship between the motor mount base and the support portions.
Figure 7:
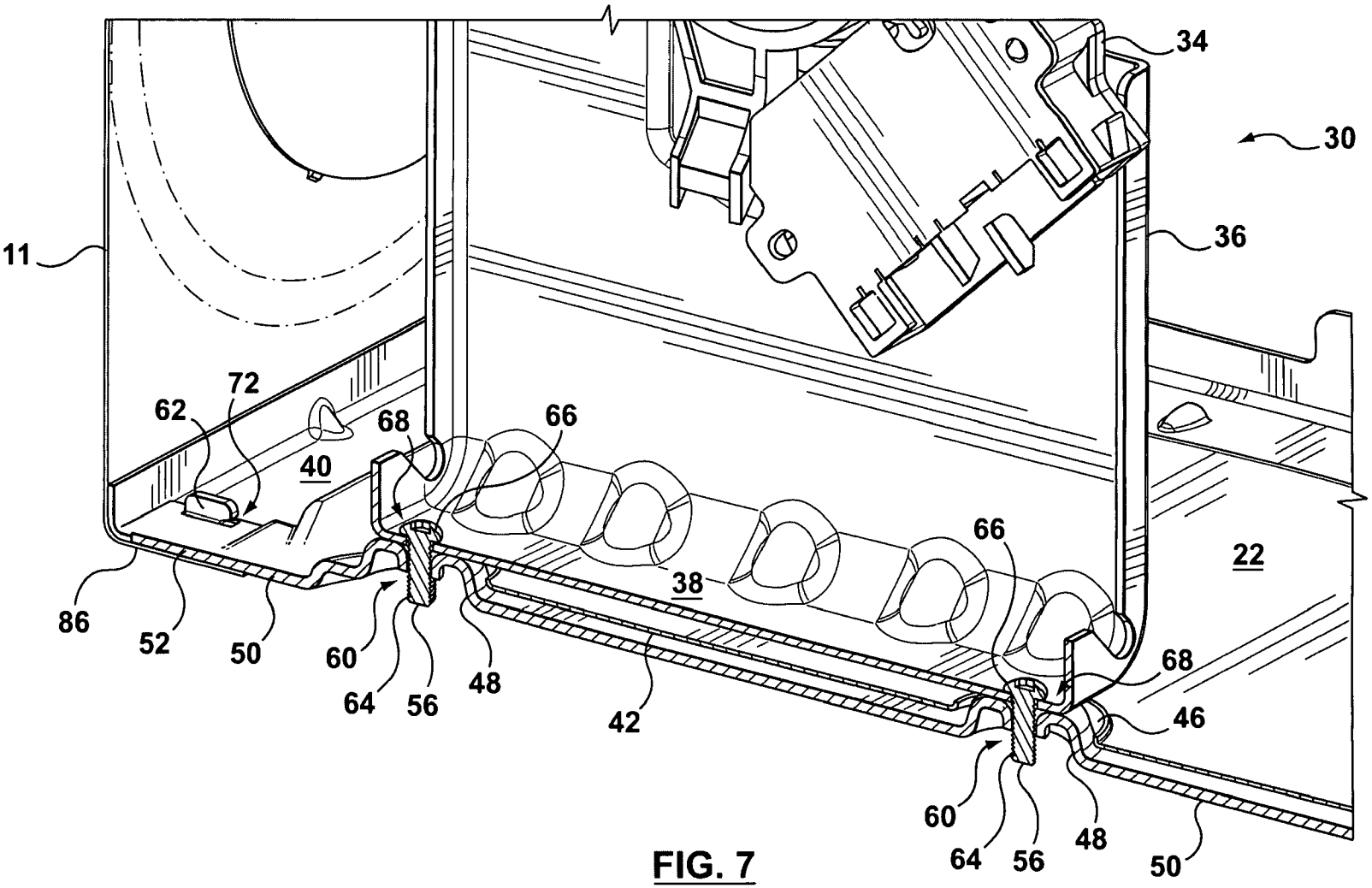
FIG. 7 is a perspective view of one embodiment of the present invention, showing the attachment of the end portions to the floor.

As shown in FIGS. 5, 6 and 7, the end portions 52 of the support portions 50 may further comprise bendable locating tabs 62. In FIGS. 5 and 7, it is shown that each of the tabs 62 passes through a corresponding aperture 72 in the outer peripheral portion 40. Each aperture 72 is configured to permit the passage of the tab 62 therethrough. Each locating tab 62 is then bent in order to locate the end portion 52 to the outer peripheral portion 40 of the cabinet floor 22. In the preferred embodiment, each end portion 52 further comprises an end portion hole 70, as shown in FIG. 4. Accordingly, as shown in FIG. 5, the outer peripheral portion 40 comprises a peripheral portion hole 82 co-located and corresponding to the end portion hole 70. Other embodiments may comprise more than one end portion hole 70 and accordingly, more than one corresponding peripheral portion hole 82. Each end portion 52 is secured with the outer peripheral portion 40 by a fastener such as a screw or rivet (not shown) passing through the end portion hole 70 and the peripheral portion hole 82. The screw may comprise either a threaded screw or a bolt engaged by a corresponding nut (not shown).

Figure 5B:
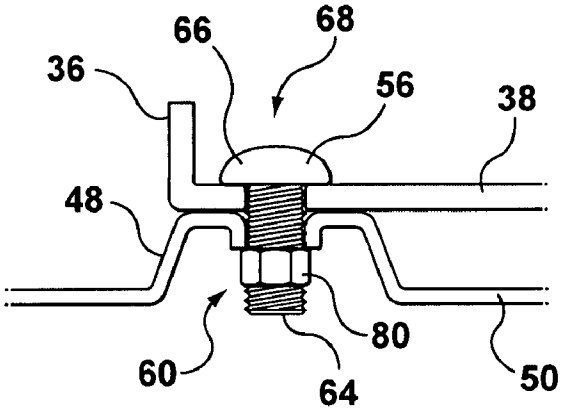
FIGS. 5*a*, 5*b*, 5*c* and 5*d* are cross-section drawings of different embodiments of the engagement between the motor mount base and a support portion.
Figure 5D:
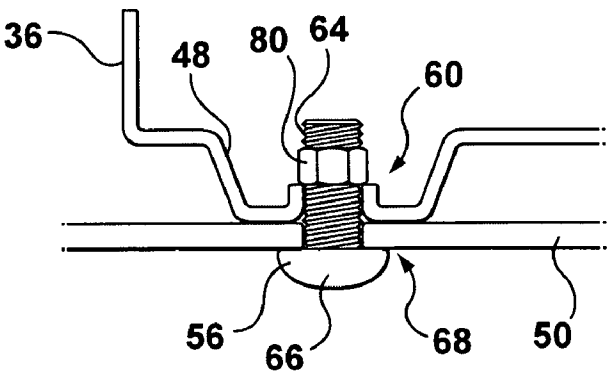
Figure 5A:
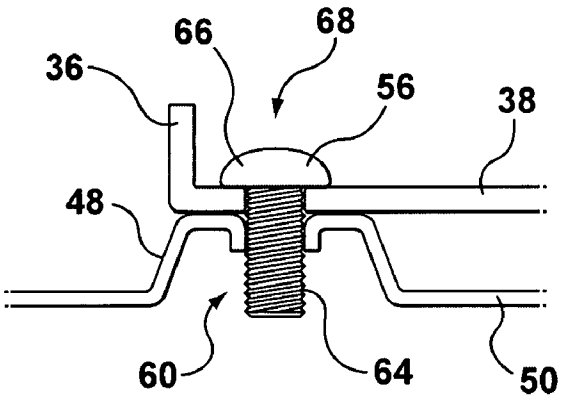

Referring to FIGS. 5*a* and 6, each projection 48 may comprise a hole 60 passing at least partially therethrough. The projection 48 may further comprise a recess 58 via which the hole 60 passes to pass at least partially through the projection 48. In the preferred embodiment, the hole 60 is threaded in order to receive a screw 56. The screw 56 comprises a threaded shaft portion 64 and a head portion 66. In FIG. 5*a*, the base 38 comprises an unthreaded hole 68 passing therethrough aligned with the threaded hole 60. The number of projections 48 corresponds to the number of unthreaded holes 68. The hole 60, the threaded shaft portion 64 and the unthreaded holes 68 correspond in diameter. The threaded shaft portion 64 of the screw 56 passes through the unthreaded hole 68 of the base 38 and is threadably received by the hole 60 of the projection 48. The motor mount base 38 is positively secured to the support portion 50 in order to provide a rigid structure for supporting the motor assembly 30. It should be understood that, alternatively, the projections 48 may extend from the motor mount base 38. Accordingly, the unthreaded hole 68 would pass through the support portion 50. Further to this alternative embodiment, the screw 56 would pass through the support portion 50 via the unthreaded hole 68 to be received by the threaded hole 60 of the projection 48.

Referring to FIGS. 5*b* and 6, an alternative embodiment is shown in which the holes 60 may be unthreaded holes passing through the projection 48 and the support portion 50. Each hole 60 may further comprise a central axis (not shown) passing therethrough. The motor mount base further comprises unthreaded holes 68 passing therethrough, the unthreaded holes 68 corresponding in number to the projections 48. The unthreaded holes 68 and the holes 60 are aligned along the central axis. The threaded shaft portion 64, the unthreaded hole 68 and the hole 60 correspond in diameter. The threaded shaft portion 64 passes through the holes 60 and through the unthreaded holes 68 of the motor mount base 38 to be threadably engaged by a nut 80 to secure the motor mount base 38 with the support portion 50, once the nut 80 is tightened. The nut 80 is greater in diameter than the threaded shaft portion. It should be understood that the projections 48 may extend from the motor mount base 38. Accordingly, the unthreaded holes 68 would pass through the support portion 50. The bolt 56 may pass through the unthreaded holes 60 and 68 in either the upwards or the downwards direction.

Figure 5C:
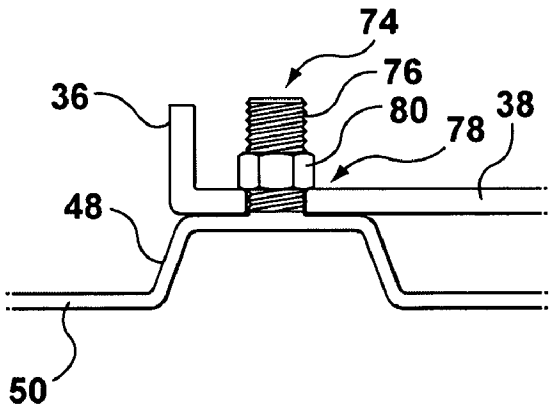

Referring to FIG. 5*c*, another embodiment is shown wherein the projection 48 may comprise a projection end portion 74 comprising a threaded post 76. The motor mount base 38 may comprise unthreaded holes 78 passing therethrough, with each unthreaded hole 78 and threaded post 76 corresponding in diameter. The threaded post 76 passes through the unthreaded hole 78 to be threadably engaged by a nut 80 to secure the motor mount base 38 with the support portion 50. It should be understood that, alternatively, the projections 48 may extend from the motor mount base 38. Accordingly, the threaded post 76 would pass through an unthreaded hole 78 passing through the support portion 50.

Figure 9:
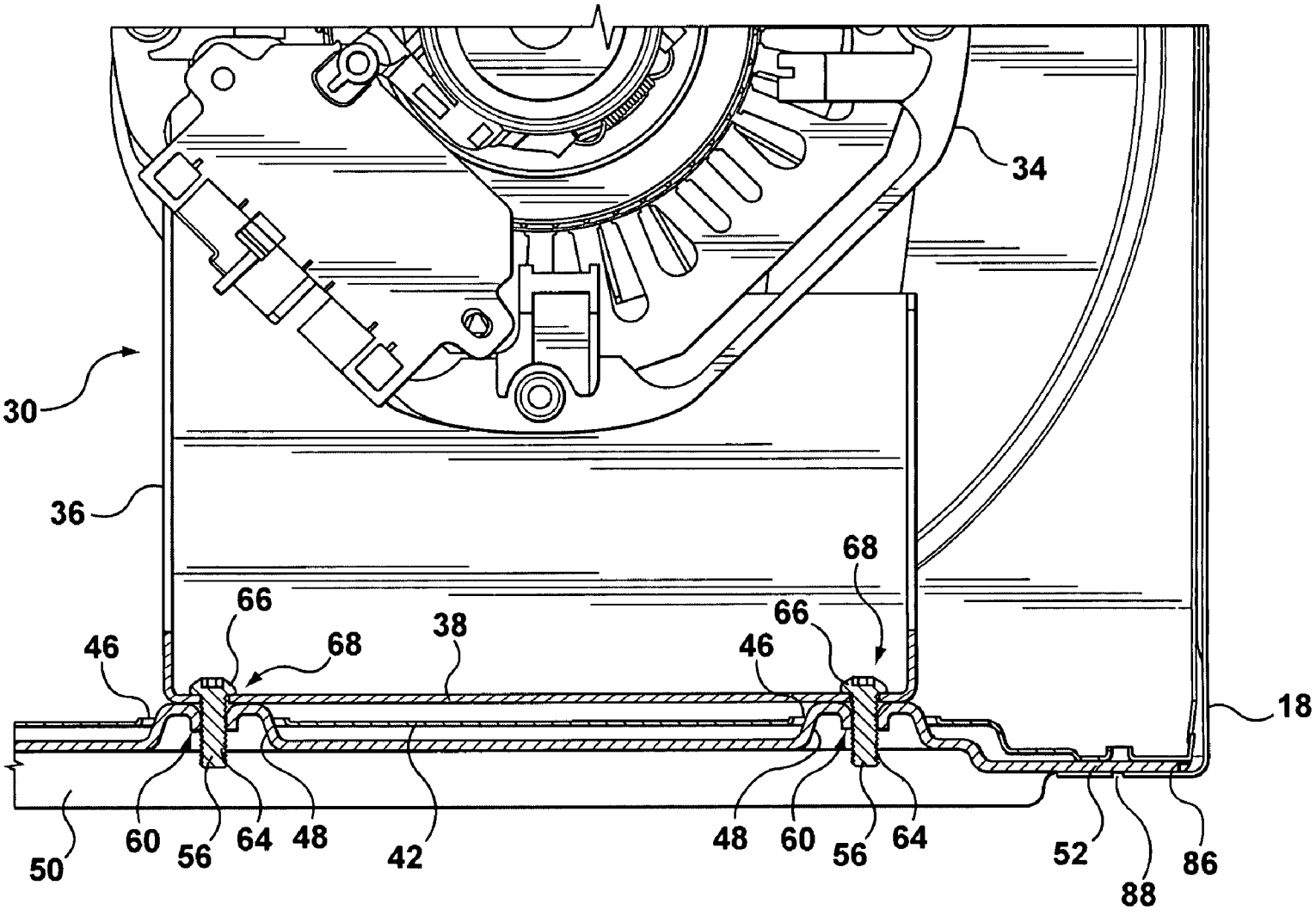
FIG. 9 is a side view of the present invention also showing the mounting of the end portions to the cabinet.

As shown in FIGS. 7, 8 and 9, in the preferred embodiment, the end portions 52 are sandwiched between an inwardly depending flange portion 86 depending from each of the cabinet side walls 18, 20. The cabinet side walls 18, 20 are secured to the cabinet 11 prior to the fastening of the end portion 52 to the floor 22. In FIGS. 8 and 9, it is shown that the inwardly depending flange portion 86 comprises a flange hole 88 which permits the passage of a rivet, screw or bolt (not shown) for fastening the end portion 52 to the outer peripheral portion 40 of the floor 22. Once the fastening screw or rivet is tightened, the sandwiched end portion 52 is held fast relative to the outer peripheral floor portion 40 and the flange portion 86 of one of the side walls 18, 20, and is prevented from moving in any direction relative thereto.

An advantage of the present invention lies in the increased rigidity of the support assembly 54 supporting the motor assembly 30. The support portions 50 are preferably made from a material that is rigid. Preferably, the projections 48 are composed of the same material as the rest of the support portion 50. However, provided that the projections 48 are made of a material that is rigid, it may be made of a different material than the support portion 50. Materials may include, but are not limited to steel, aluminum or rigid plastics, for example. The rigid material of the support assembly 54 does not resonate with the vibration frequency of the motor 34 and reduces vibration transmittance from the support assembly 54 to the cabinet 11. This assists in reducing noise generated by the operation of the dryer 10.

In the preferred embodiment, the support assembly 54 is secured to the outer peripheral portion 40 of the cabinet floor 22 in three ways. First, the locating tabs 62 positively locate the support portions 50 to the cabinet floor 22. Second, the end portions 52 are fastened to the outer peripheral floor portion 40 by a screw or a bolt. Third, the end portion is sandwiched between the cabinet floor outer peripheral portion 40 and the inwardly depending flange portion 86 of the cabinet side wall 18, 20. By securing the support assembly 54 in this fashion, the support portions 50 are held fast and are prevented from moving even slightly in any direction relative to the floor and side wall. Further, the outer peripheral portion 40 is a more rigid area of the cabinet floor 22 than the central portion 42. By securing the end portions 52 at the outside peripheral portion 40, the contact between the support assembly 54 and the cabinet 11 is limited. Further, the outer peripheral portion 40 is one of the most rigid portions of the cabinet 11, since the rear wall 16 and the side walls 18, 20 are secured with the outer peripheral portion 40. Thus, the rigidity of the outer peripheral portion 40 combined with the limited contact relationship between the support assembly 54 and the outer peripheral portion 40 and the holding fast of the end portions 52 serves to further reduce or eliminate vibration transmitted from the motor 34 to the cabinet 11.

In an alternative embodiment, the support assembly 54 may comprise a single support portion 50 that is spaced below the floor 22. In this embodiment, the single support portion 50 may resemble the support portion 50 shown in FIG. 6. The support portion 50 comprises at least one projection 48 extending therefrom towards the motor mount base 38 to secure the motor mount base 38 with the support portion 50.

Referring to FIG. 6*a*, another embodiment of the support assembly 54 is shown wherein the support assembly 54 comprises a single support portion 50 in the shape of a rectangular frame. The support portion 50 comprises two projections 48 extending therefrom towards the motor mount base 38 to secure the base 38 with the support portion 50. Accordingly, the floor 22 comprises two openings 46 for the passage of the projections 48 therethrough. Preferably, the projections 48 are spaced apart and located so as to evenly distribute the load of the motor assembly 30 onto the support portion 50. However, this is not necessary provided that the motor assembly 30 is sufficiently supported to permit the functioning of the present invention. The support portion 50 further comprises oppositely disposed end portions 52 by which the support portion 50 is secured with the outside peripheral portion 40 of the cabinet floor 22.

Referring to FIG. 6*b*, in yet another embodiment, the support assembly 54 may comprise a support portion 50 comprising a rectangular shelf. The support portion 50 of this embodiment comprises four projections 48 extending therefrom. The number of openings 46 corresponds to the number of projections 48. Each projection 48 will extend towards the motor mount base 38 to secure the base 38 with the support portion 50. It is preferable that the projections 48 are located so as to evenly distribute the load of the motor assembly (not shown) onto the support portion 50. However, this is not necessary provided that the motor assembly is sufficiently supported to permit the functioning of the present invention.

While the invention has been described in terms of various specific embodiments, those skilled in the art will recognize that the invention can be practiced with modifications within the scope of the present invention as disclosed herein.

What is claimed is:

1. A clothes dryer comprising:

a cabinet comprising a floor, the floor comprising a central portion, an outside peripheral portion, and at least one opening passing through the central portion;

a motor assembly located inside the cabinet and spaced above the floor over the at least one opening, the motor assembly comprising a motor and a motor mount for mounting of the motor thereto, the motor mount comprising a base;

a support assembly comprising at least one support portion spaced below and spanning across the central portion of the floor of the cabinet and passing beneath the at least one opening;

the support portion comprising oppositely disposed end portions secured with the outside peripheral portion of the floor;

one of the support portion and the motor mount base further comprising at least one projection extending therefrom toward the other one of the support portion and the motor mount base; and, the at least one projection passing through the at least one opening with clearance to secure the support portion with the base of the motor mount whereby the motor is supported within the cabinet and is isolated from the central portion of the floor.

2. A clothes dryer as in claim 1 wherein:

the cabinet further comprises front, rear, and side walls mounted to the outside peripheral portion of the floor.

3. A clothes dryer as in claim 1 wherein:

the clothes dryer further includes a rotating drum mounted in the cabinet and the motor drives the drum via a transmission.

4. A clothes dryer as in claim 1 wherein:

the support portion comprises at least one material more rigid than the floor of the cabinet for reducing vibration transmitted from the motor to the cabinet floor via the support portion.

5. A clothes dryer as in claim 1 wherein:

the other one of the motor mount base and the support portion comprises an unthreaded hole passing therethrough;

the at least one projection comprising a threaded hole passing at least partially therethrough, the threaded hole aligned with the unthreaded hole;

the support portion is secured to the motor mount base by a screw, the screw comprising a threaded shaft portion and a head portion, the head portion being greater in diameter than the shaft portion;

the unthreaded hole, the threaded hole and the shaft portion corresponding in diameter; and, the screw passing through unthreaded hole of the other one of the motor mount base and the support portion to be threadably received by the threaded hole of the projection.

6. A clothes dryer as in claim 1 wherein:

the motor assembly, the support assembly, and the at least one opening are co-located away from a center of the central portion of the floor.

7. A clothes dryer as in claim 4 wherein:

a center of the central portion of the floor comprises a first resonant frequency corresponding to a frequency of motor vibration; and, the at least one material comprising the support portion comprises a second resonant frequency that is different from the first resonant frequency and a harmonic thereof.

8. A clothes dryer as in claim 5 wherein:

the at least one projection comprises a dome-shaped prominence comprising a central recess; and, the threaded hole passing at least partially through the projection via the central recess.

9. A clothes dryer as in claim 1 wherein:

the projection comprises a projection end portion, the projection end portion comprises a threaded post;

the other one of the motor mount base and the support portion comprising an unthreaded hole passing therethrough, the threaded post and the unthreaded hole corresponding in diameter;

the threaded post passing through the corresponding unthreaded hole; and, the threaded post threadably engaged by a nut to secure the motor mount base with the support portion.

10. A clothes dryer as in claim 1 wherein:

each projection comprises an unthreaded projection hole passing therethrough;

each projection hole comprises a central axis passing therethrough;

the support portion and the motor mount base comprising unthreaded holes passing therethrough, the unthreaded holes aligned along the central axis;

a screw comprising a head portion and a threaded shaft portion secures the support portion with the motor mount base, the head portion and the nut being greater in diameter than the threaded shaft portion;

each of the projection holes, the unthreaded holes and the threaded shaft portion corresponding in diameter;

the threaded shaft portion passing through each of the projection holes and the unthreaded holes to be threadably engaged by a nut;

the nut being greater in diameter than the threaded shaft portion; and, the head portion and the nut portion sandwiching the motor mount base, the projection and the support portion to positively secure the motor mount base with the support portion as the nut is tightened.

11. A clothes dryer as in claim 2 wherein:

the end portions each further comprise at least one bendable locating tab;

each locating tab passing through a corresponding aperture in the outer peripheral portion, the aperture configured to permit the passage of the locating tab therethrough;

the bendable locating tab being bent to locate the support assembly relative to the floor;

each end portion further comprises at least one end portion hole;

the outer peripheral portion having at least one peripheral portion hole, the peripheral portion hole being aligned with the end portion hole;

each end portion fastened to the outer peripheral portion by a threaded screw passing through the end portion hole and the peripheral portion hole; and, the threaded screw positively securing the end portion with the outer peripheral portion.

12. A clothes dryer as in claim 1 wherein:

the floor comprises at least two spaced apart openings passing through the central portion of the floor;

the support assembly comprises two parallel spaced apart support portions;

each support portion comprises at least one projection extending therefrom toward the motor mount base;

each projection passing through a corresponding one of the openings with clearance to secure each of the support portions with the base of the motor mount.

13. A clothes dryer as in claim 1 wherein:

the floor comprises at least two spaced apart openings passing through the central portion of the floor;

the support assembly comprises one support portion comprising a rectangular frame;

the support portion comprising at least two spaced apart projections extending therefrom toward the motor mount base; and, each projection passing through a corresponding one of the openings with clearance to secure the support portion with the base of the motor mount.

14. A clothes dryer as in claim 1 wherein:

the support assembly comprises one support portion comprising a rectangular shelf.

15. A clothes dryer as in claim 11 wherein:

the cabinet side walls each comprise an inwardly depending flange portion for attachment of the side wall to the cabinet floor;

the inwardly depending flange portion and the outer peripheral portion of the floor sandwich the support portion end portions;

the inwardly depending flange portion further comprises flange holes, aligned with and corresponding in diameter to the end portion holes and the peripheral portion holes, for the passage of the threaded bolt or screw therethrough;

the threaded bolt or screw passing through the flange hole, the end portion hole and the peripheral portion hole to positively secure the end portion.

16. A clothes dryer comprising:

a cabinet comprising a floor;

the floor comprising a central portion, an outside peripheral portion, and at least two openings passing through the central portion;

a motor assembly located inside the cabinet and spaced above the floor over the openings, the motor assembly comprising a motor and a motor mount for mounting of the motor thereto, the motor mount comprising a base;

a support assembly comprising two parallel spaced apart support portions each spaced below and spanning across the central portion of the floor of the cabinet, the support portions passing beneath the openings;

each support portion comprising oppositely disposed end portions secured with the outside peripheral portion of the floor;

each support portion comprises at least one projection extending from the support portion toward the motor mount base;

each projection passing through a corresponding one of the openings with clearance to secure the support portion with the base of the motor mount whereby the motor is supported within the cabinet and is isolated from the central portion of the floor.

17. A clothes dryer as in claim 16 wherein:

the support assembly, the motor assembly, and the at least two openings are co-located away from a center of the central portion of the floor.

18. A clothes dryer as in claim 16 wherein:

the cabinet further comprises front, rear, and side walls mounted to the outside peripheral portion of the floor.

19. A clothes dryer as in claim 16 wherein:

the dryer further includes a rotating drum mounted in the cabinet and the motor drives the drum via a transmission.

20. A clothes dryer as in claim 16 wherein:

the support portion comprises at least one material more rigid than the floor of the cabinet for reducing vibration transmitted from the motor to the cabinet via the support portion.

21. A clothes dryer as in claim 20 wherein:

a center of the central portion comprises a first resonant frequency corresponding to a motor vibration frequency; and, the at least one material comprising the support portion comprises a second resonant frequency that is different from the first resonant frequency and a harmonic thereof.

22. A clothes dryer as in claim 16 wherein:

the motor mount base comprises at least one unthreaded hole passing therethrough;

each projection comprises a threaded hole passing at least partially therethrough, the threaded hole aligned with the unthreaded hole;

the support portion is secured to the motor mount base by a screw, the screw comprising a threaded shaft portion and a head portion, the head portion being greater in diameter than the shaft portion;

the unthreaded hole, the threaded hole and the shaft portion corresponding in diameter; and, the screw passing through the motor mount base to be threadably received by the threaded hole of each projection to positively secure the motor mount base with the support portion.

23. A clothes dryer as in claim 22 wherein:

each projection comprises a dome-shaped prominence comprising a central recess;

the threaded hole passing at least partially through the projection via the central recess.

24. A clothes dryer as in claim 16 wherein:

each projection comprises a projection end portion, the projection end portion comprises a threaded post;

the motor mount base comprises at least two unthreaded holes passing therethrough, the threaded post and the unthreaded holes corresponding in diameter;

each threaded post passing through a corresponding one of the unthreaded holes; and, the threaded post threadably engaged by a nut to secure the motor mount base with the support portion.

25. A clothes dryer as in claim 16 wherein:

the support portion comprises at least two projections;

each projection comprises an unthreaded projection hole passing therethrough;

each projection hole comprises a central axis passing therethrough;

the support portion and the motor mount base each comprising at least two unthreaded holes passing therethrough, the unthreaded holes aligned along the central axis;

at least two screws, each comprising a head portion and a threaded shaft portion, secure the support portion with the motor mount base;

each head portion being greater in diameter than each of the threaded shaft portions;

each of the projection holes, the unthreaded holes and the threaded shaft portion corresponding in diameter;

the threaded shaft portion passing through each of the projection holes and the unthreaded holes to be threadably engaged by a nut;

each nut being greater in diameter than each of the threaded shaft portions; and, the head portion and the nut portion sandwiching the motor mount base, the projection and the support portion to positively secure the motor mount base with the support portion as the nut is tightened.

26. A clothes dryer as in claim 18 wherein:

the end portions each further comprise at least one bendable locating tab;

each locating tab each passing through a corresponding aperture in the outer peripheral portion, the aperture configured to permit the passage of the locating tab therethrough;

the bendable locating tab being bent to locate the support assembly relative to the floor;

each end portion further comprises at least one end portion hole;

the outer peripheral portion having at least one peripheral portion hole, the peripheral portion hole being co-located and corresponding to the end portion hole; and, each end portion secured with the outer peripheral portion by a threaded screw passing through the end portion hole and the peripheral portion hole.

27. A clothes dryer as in claim 26 wherein:

the cabinet side walls each comprise an inwardly depending flange portion for attachment of the side wall to the cabinet floor;

the inwardly depending flange portion and the outer peripheral portion of the floor sandwich the support portion end portions;

the inwardly depending flange portion further comprises side wall holes aligned with and corresponding in diameter to the end portion holes and the peripheral portion holes for the passage of the threaded bolt or screw therethrough;

the threaded bolt or screw passing through the side wall hole, the end portion hole and the peripheral portion hole to secure the end portion.

28. A clothes dryer comprising:

a cabinet comprising a floor;

the floor comprising a central portion, an outside peripheral portion, and four openings passing through the central portion;

a motor assembly located inside the cabinet and spaced above the floor over the openings;

the motor assembly comprising a motor and a motor mount for mounting of the motor thereto;

the motor mount comprising a base;

a support assembly comprising two parallel spaced apart support portions each spaced below and spanning across the central portion of the floor of the cabinet the support portions passing beneath the openings;

each support portion comprising oppositely disposed end portions secured with the outside peripheral portion of the floor;

each support portion comprises two projections extending from the support portion toward the motor mount base;

each projection passing through a corresponding one of the openings with clearance to secure the support portion with the base of the motor mount, whereby the motor is supported within the cabinet and is isolated from the central portion of the floor; and the motor assembly, the support assembly, and the four openings are co-located away from a central portion of the floor.

* * * * *